US008781746B2

(12) United States Patent
Schneider et al.

(10) Patent No.: US 8,781,746 B2
(45) Date of Patent: Jul. 15, 2014

(54) SYSTEM AND METHOD FOR OBTAINING AND USING DOWNHOLE DATA DURING WELL CONTROL OPERATIONS

(75) Inventors: Barry Schneider, Houston, TX (US); Curtis Cheatham, The Woodlands, TX (US); Charles Mauldin, Spring, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 1414 days.

(21) Appl. No.: 11/847,904

(22) Filed: Aug. 30, 2007

(65) Prior Publication Data

US 2009/0063055 A1 Mar. 5, 2009

(51) Int. Cl.
*G01V 1/40* (2006.01)

(52) U.S. Cl.
USPC ..... 702/9

(58) Field of Classification Search
CPC ..... G01V 1/40; G01V 1/44; G01V 1/48; G01V 1/50
USPC ..... 702/6–13; 166/251.1, 252.1
See application file for complete search history.

(56) References Cited

U.S. PATENT DOCUMENTS

| | | | | |
|---|---|---|---|---|
| 3,552,502 | A * | 1/1971 | Wilson, Sr. | 175/25 |
| 4,041,780 | A * | 8/1977 | Angehrn | 73/152.02 |
| 4,797,822 | A * | 1/1989 | Peters | 702/11 |
| 6,467,341 | B1 * | 10/2002 | Boucher et al. | 73/152.43 |
| 6,484,816 | B1 | 11/2002 | Koederitz | |
| 6,608,565 | B1 * | 8/2003 | Van Steenwyk et al. | 340/855.4 |
| 6,714,138 | B1 * | 3/2004 | Turner et al. | 340/854.3 |
| 6,880,634 | B2 * | 4/2005 | Gardner et al. | 166/250.01 |
| 6,990,045 | B2 * | 1/2006 | Jackson | 367/81 |
| 2004/0065477 | A1 | 4/2004 | Paulk et al. | |

FOREIGN PATENT DOCUMENTS

| | | | |
|---|---|---|---|
| AU | 200112054 | B2 | 4/2001 |
| EP | 1 898 044 | A3 | 5/2008 |
| GB | 2 368 861 | A | 5/2002 |
| GB | 2 441 847 | A | 3/2008 |

OTHER PUBLICATIONS

Neal Adams, "Underground blowout causes and symptoms: although always caused by a pressure differential, there are many ways that flow can be initiated and signs of a problem may not be obvious", World Oil, Jan. 2005, 8 pages.*

(Continued)

*Primary Examiner* — Mohamed Charioui
(74) *Attorney, Agent, or Firm* — Wong, Cabello, Lutsch, Rutherford & Brucculeri LLP

(57) ABSTRACT

A tool driver activates a telemetry tool when a predetermined threshold of accelerometer data measured by an accelerometer. The threshold preferably corresponds to an acceleration level expected while drilling mud is pumped at a slow pump rate through the well's drill pipe. When a fluid influx occurs during drilling, the well is shut-in, and the tool driver turns off the telemetry tool. The drill pipe and casing pressures of the shut-in well are obtained. Then, drilling mud having a first weight is pumped at a slow mud pump rate. Because the tool driver is set to activate the telemetry tool in response to accelerometer data at the slow pump rate, the telemetry tool begins sending downhole pressure data to the surface. In this way, rig operations can change the mud weight and adjust the choke line during the kill operation based on an analysis of the downhole pressure data obtained.

27 Claims, 6 Drawing Sheets

(56) References Cited

OTHER PUBLICATIONS

Adamson, Keelan, et al., "High-Pressure, High-Temperature Well Construction", Oilfield Review, Summer 1998, pp. 36-49.*
"HEL™ MWD System—Bore/Annular Pressure (BAP™) Sensor", Weatherford International Ltd., 2006, 2 pgs.
"HEL™ MWD System", Weatherford International Ltd., 2006, 1 pg.
"HEL™ MWD System—Environmental Severity Measurement (ESM™) Sensor", Weatherford International Ltd., 2006, 3 pgs.
"HEL™ MWD System—High-Temperature Azimuthal Gamma Ray (HAGR™) Sensor", Weatherford International Ltd., 2006, 3 pgs.
"Well Control Worksheet", University of Houston—Victoria, date unknown, 2 pgs.
"Choke Line Friction Pressures—Deepwater Example", Randy Smith Training Solutions, date unknown, 12 pgs.
Ward, Chris, et al., "Pore and Fracture Pressure information from PWD data", 2000 AADE Drilling Technology Forum, Feb. 9-10, 2000, 11 pgs.
Hannegan, Don M., et al., "Technologies Manage Well Pressures", The American Oil & Gas Reporter, Sep. 2001, 5 pgs.
"Precision Pulse™ MWD System", Weatherford International, Ltd., 2006, 2 pgs.
Jonggeun, Choe, et al., "Well-Control Analyses on Extended-Reach and Multilateral Trajectories", SPE Drilling & Completion, Jun. 2005, pp. 101-108.
European Search and Examination Report received in corresponding application No. GB0810462.2 dated Aug. 1, 2008.
First Office Action in counterpart Canadian Appl. 2,635,448, dated Jan. 14, 2010.
Notice of Acceptance in counterpart Canadian Appl. 2,635,448, dated Mar. 2, 2011.
First Examination Report in counterpart Australian Appl. 2008202508, dated Jan. 11, 2010.
Notice of Acceptance in counterpart Australian Appl. 20082020508, dated Feb. 1, 2011.

* cited by examiner

SYSTEM AND METHOD FOR OBTAINING AND USING DOWNHOLE DATA DURING WELL CONTROL OPERATIONS

FIELD OF THE DISCLOSURE

The subject matter of the present disclosure generally relates to well control operations for oil and gas wells and more particularly relates to a system and method for obtaining and using downhole data during well control operations.

BACKGROUND OF THE DISCLOSURE

FIG. 1A illustrates a typical prior art drilling system. During drilling, drilling fluid ("mud") is pumped by mud pumps 40 through the drill string 30, drill bit 32, and back to the surface through the annulus 14 between drill string 30 and the wellbore 10. While drilling, it is known in the art to use an accelerometer on a tool string downhole to measure tool shock and drilling vibration. This information can alert rig operators when harmful downhole vibrations are occurring that will require a changing in the drilling operation. In addition, it is known in the art to measure pressures and temperatures downhole and to relay the measured data to the surface using pressure modulated telemetry techniques. In such prior art implementations, pulsing of any measured data to the surface is not begun until the accelerometer measures a value that at least exceeds certain set thresholds or a pressure transducer samples data above a preset threshold.

To control the hydrostatic pressure of fluids in the formation 16 penetrated by the wellbore 10, the density of the drilling mud is controlled by various weighting agents known in the art. The weight of this mud often is controlled to prevent loss of well control or blowout. For example, a mud weight that exceeds the fracture strength of the exposed portion of the formation 16 below the casing 12 in the wellbore 10 can fracture the formation 16 and cause mud to be lost, and potentially result in loss of well control.

Alternatively, a mud weight that falls below the pore pressure of exposed portion of the formation 16 can allow an influx of fluid to occur in the wellbore 10. For example, a zone may be encountered in the formation 16 that has a higher pore pressure than the wellbore fluid pressure applied by the mud. This causes a "kick" or influx of formation fluid (liquid, gas, or both) into the wellbore 10 that can be detrimental to the operation. When such a kick occurs, rig operators perform well control operations to circulate the influx of formation fluid out of the wellbore 10 and regain control of the wellbore pressure for drilling.

Because the influx of formation fluid (liquid and/or gas) reduces the density of the drilling fluid in the wellbore annulus 14, the kick can be detected by evidencing a change in pressure in the wellbore annulus 14 or a change in mud density in the wellbore annulus 14, the kick can be detected by a gain in drilling fluid volume in the tanks or pits 42 for the mud system. When the kick is detected, rig operators then implement a well control operation to circulate the influx of formation fluids out of the wellbore 10 and regain control of the well again.

Two well control operations are widely used in the oil and gas industry to regain control after a kick. A first method is called the Wait & Weight (or Engineer's) method, while the second method is called the Driller's method. When a kick is detected in both methods, rig operators initially stop the mud circulation, shut-in the wellbore 10 using the blow-out preventer (BOP) 20, and measure the pressure buildup in the wellbore annulus 14, gain in the mud tanks 42, and shut-in pressure of the drill pipe 30. Calculations are then made to determine a kill weight of mud that has a high enough density to produce hydrostatic pressure at the point of influx in the wellbore 10 that will stop the flow of formation fluid into the wellbore 10.

Both the Engineer's and the Driller's methods have their advantages and disadvantages, and the choice of one method over the other may depend on various considerations, including operator preference as well as the circumstances involved in a particular well control situation such as the volume of the kick, the margin between the mud weight in the annulus 14 when the kick is taken and the minimum fracture gradient strength in the wellbore 10, and the increase required in mud weight to regain well control. Advantages of the Engineer's method include: (1) in many cases, only one circulation of the wellbore 10 is required to circulate out the kick and replace the original weight mud with kill weight mud, which can save rig time, and (2) in many cases, the maximum wellbore pressure at the last exposed casing shoe is less than the Driller's method, thereby reducing chances of fracturing the openhole during well control, which can require additional rig time to regain control. Advantages of the Driller's method include: (1) the implementation of the method is more straightforward because one circulation of the wellbore 10 is performed using the original weight mud to circulate out the kick, and a second circulation of the wellbore 10 is preformed using kill weight mud to regain well control, and (2) in some cases, the kick is circulated out of the wellbore 10 more quickly; for example, when significant time is required to increase the rig's active mud system to the necessary kill weight mud.

As an example of one of the two common methods, FIG. 1B shows a flow chart of the Engineer's method 100 according to the prior art. Although not shown in this flow chart, slow pump rates of the mud pumps 40 and choke/kill line friction tests are run at predetermined intervals during drilling prior to taking the kick. These slow pump rates are typically one-half to one-third of the normal circulation rate of the pumps 40 while drilling new formation. These tests and measurements help determine the frictional pressure losses created by flowing through the choke/kill line 50/60 for given mud properties at several flow rates. The intention of making these measurements prior to taking a kick is to be better prepared to implement well control operations should they become necessary. For example, the data and measurements help to optimize the mud flow rate during kill operations, with the goal of reducing the amount of time needed to regain well control while taking special care not to exert too high or too low of a pressure to the formation 16. While important in all drilling applications, these tests and measurements area of even greater importance when drilling with a subsea BOP 20 where the choke and kill lines 50/60 may be up to 10,000-feet in length and may produce more significant pressure losses in the choke and the kill lines, which greatly complicates maintaining wellbore pressure within the desired limits during the well control operations.

While drilling, a kick due to an influx of formation fluid (liquid, gas, or any combination thereof) into the wellbore 10 may be detected (Block 105). The well is shut-in by closing the BOP 20, and rig operators record the pressures at the surface on the drill pipe 30 (Shut-In Drill Pipe Pressure SIDP) and the casing 12 (Shut-In Casing Pressure SICP) using standard techniques (Block 110). The rig operators then fill out a standard "kill" sheet to outline the procedures for circulating out the influx and regaining well control (Block 115). As known in the art, the "kill" sheet is a spreadsheet or worksheet on which rig operators pre-record information about slow pump pressures at specific mud pump flow rates (psi @ SPM), choke line friction pressures at specific mud pump flow rates (psi @ SPM), true pump output (linear diameter, stroke length, and efficiency), drill string capacity and other details, annular capacity and other details, and the casing 12 specifics such as inner diameter, burst pressure rating, and the depth of the casing shoe Operators also input measurements such as Shut-in Drill Pipe Pressure (SIDPP), Shut-In Casing Pressure (SICP), and Pit Gain. Using information and calculations on the kill sheet, the rig operators can then determine the kill weight mud (KWM), initial circulation pressure (ICP), final circulating pressure (FCP), maximum allowable casing pressure (MCP), and pressure decline schedule for performing a well control operation.

Using the calculated weight required for the mud to kill the influx, rig operators "weight up" the active mud system by increasing the density of the drilling mud in tanks 42 using known techniques (Block 120). Then, the rig operators circulate the kill weight mud into the system by pumping it into the drill pipe 30 at a flow rate determined from the kill sheet (Block 125).

During the pumping, the rig operators monitor the pressures at the standpipe to ensure that the proper pressure is exerted on the formation 16 because pumping too heavy of a mud at too high of a rate could damage the formation 16 whereas too low of a pressure could cause an additional influx. Once the mud reaches the bit, the drill pipe pressure is recorded in order to adjust the choke 62 to keep the drill pipe pressure constant while the kill weight mud is circulated up the wellbore 10 to the surface.

Once a full circulation of kill weight mud has been pumped, the rig operators shut off the pumps 40 and monitor for pressure build up on the drill pipe 30 or the casing 12 (Block 135) and determine if there is a build up of pressure (Decision 140). Such a build up of pressure on the drill pipe 30 or casing 12 after shut-in would indicate that the influx has not been properly killed. If there is a build up, then the process must be repeated by closing the BOP 20, recording pressures, recalculating information in the kill sheet, etc. If there is no build up, then the uncontrolled flow of formation fluid into the wellbore 10 has been stopped, and the rig operators can resume normal drilling operations (Block 145).

In the Engineer's method described above as well as in the Driller's method, rig operators control pressure on the casing 12 and/or drill pipe 30 by adjusting the choke 62 that conducts the mud from the casing 12 to a mud reservoir (not shown) and by operating the mud pumps 40 at previously measured slow circulating (kill) rates and corresponding pressure. The length of the choke line 60 for a surface BOP stack is generally short enough to neglect the frictional pressure loss through the choke line 60 at the slow circulating rate. However, this is not the case for a subsea BOP, where the choke line 60 is generally at least several hundred feet long. In deepwater, the choke line 60 is generally thousands of feet in length. Hence, the pressure losses through the choke line 60 for subsea BOPs due to friction are significant even at slow circulating rates.

Therefore, to be prepared for well control, rig operators need to know slow circulating rate pressures and the friction pressure drops through the choke line (i.e., choke line friction pressures). To determine slow circulating rate pressures, for example, the rig operators pump drilling mud down the drill string 30 at various pump speeds and allow the returns to pass through the riser. This process obtains the slow circulating rate pressures used to calculate the initial circulation pressures (ICP) and final circulating pressures (FCP) for the kill sheet.

Various techniques can be used to determine the choke line friction pressures, such as by pumping at slow circulating rate pressures through the kill and choke lines with the rams closed. Before drilling is commenced, for example, rig operators can determine first slow circulating rate pressures from returns through the riser. Then, rig operators can open the choke 62 fully and measure second slow circulating pressures through the choke line 60. The choke line friction pressures at the various pump rates are calculated as the difference between these two slow circulating pressures. Regardless of how obtained, the choke line friction pressure must be adjusted for changes in mud properties.

As those skilled in the art will appreciate, it is important that well control operations be performed carefully. Operators attempting to control an influx may damage the formation 16 by exerting too great of a pressure on the formation 16. Any damage to the formation 16 can cause partial or complete loss of returns and can create situations that will take considerable time and additional strings of casing 12 to regain well control and return to normal drilling operations. In extreme cases, a substantial portion of the openhole wellbore 10 may be abandoned, requiring redrilling.

In the Driller's method, the rig operators must adjust the choke 62 on the choke line 60 to keep the casing pressure equal to the shut-in casing pressure minus the choke line friction pressure while the kill mud is pumped down the drill pipe 30. Because the bottom hole pressure is determined from the sum of the casing pressure at the surface, the annular pressure, and the choke line friction pressure, the accuracy and the reliability of pressure measurements and calculations can be particularly difficult to obtain reliably on deepwater drilling rigs using subsea BOP stacks. Use of inaccurate choke line friction pressures when circulating out a kick in such an implementation could result in either an increase or decrease in the bottom hole pressure that could damage the formation 16 or cause a secondary fluid influx.

Therefore, it is important that sound procedures be used to determine the choke line friction pressures. Unfortunately, obtaining choke line friction pressures periodically throughout the drilling process only provides for the mud properties at one moment in time. Friction pressure losses in the choke line 60, annulus 14, bit 32, and drillstring 30 vary significantly with changes in the mud properties such as density and viscosity. During normal drilling operations, and especially after a kick is taken, the mud properties can vary greatly based on factors such as mud weight, viscosity, and oil/water ratios. Consequently, the friction pressure losses will also generally change significantly when the original weight mud is weighted up to provide the kill weight mud.

In addition to the above problems, prior art well control operations can be time consuming and can require extensive planning, calculations, monitoring, and human intervention to execute. Furthermore, current well control operations are not open to much flexibility. As one example, the Engineer's method may require rig operators to construct a graphical or tabular pumping schedule of pump pressure versus volume pumped, and this pumping schedule must be followed by the rig operators during well control. In another example, both the Engineer's and Driller's methods for well control use substantially constant pump rates to maintain control while executing the operation, which is not always ideal or achievable. In the event it becomes necessary to change pumping rates and/or interrupt pumping during execution of the well control procedure, it frequently may be necessary to record new shut-in pressures, new circulating pressures, and recalculate an entirely new pumping and pressure schedule.

Not only do the prior art methods consume additional rig time and thereby increase costs to the operator and risks to the well control operations, but they also provide a less than optimal ability to determine accurate bottom hole pressure. As will be appreciated, the combination of mud, formation cuttings, and influx fluid(s) in the wellbore can vary significantly foot-by-foot and over time and can create uncertainty in the determination of the actual wellbore pressure in the annulus. Moreover, obtaining accurate choke line pressure losses poses another problem in determining the actual wellbore pressure in the annulus. This problem with accurate choke line pressure losses may be particularly acute on a subsea BOP and especially in deepwater, where the effects of temperature and pressure can cause choke line friction pressures to be significantly inaccurate.

Accordingly, systems and methods are needed that can facilitate well control operations by giving rig operators real-time downhole data during a well control operation to use when executing the operation. The subject matter of the present disclosure is directed to overcoming, or at least reducing the effects of, one or more of the problems set forth above.

DETAILED DESCRIPTION

Figure 1A:
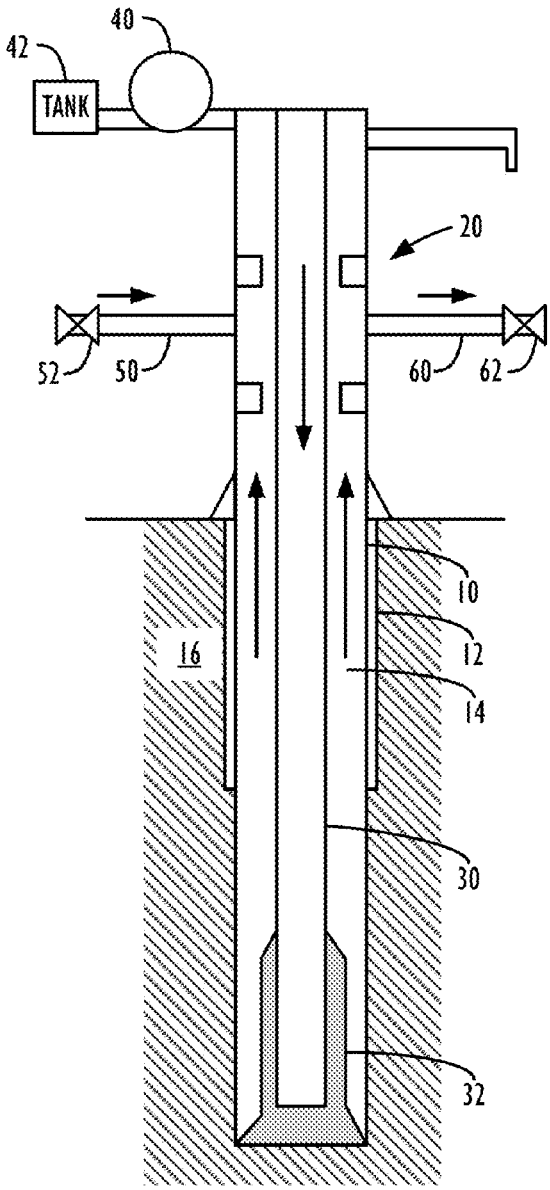
FIG. 1A (Prior Art)
FIG. 1A illustrates a typical drilling system according to the prior art.
Figure 1B:
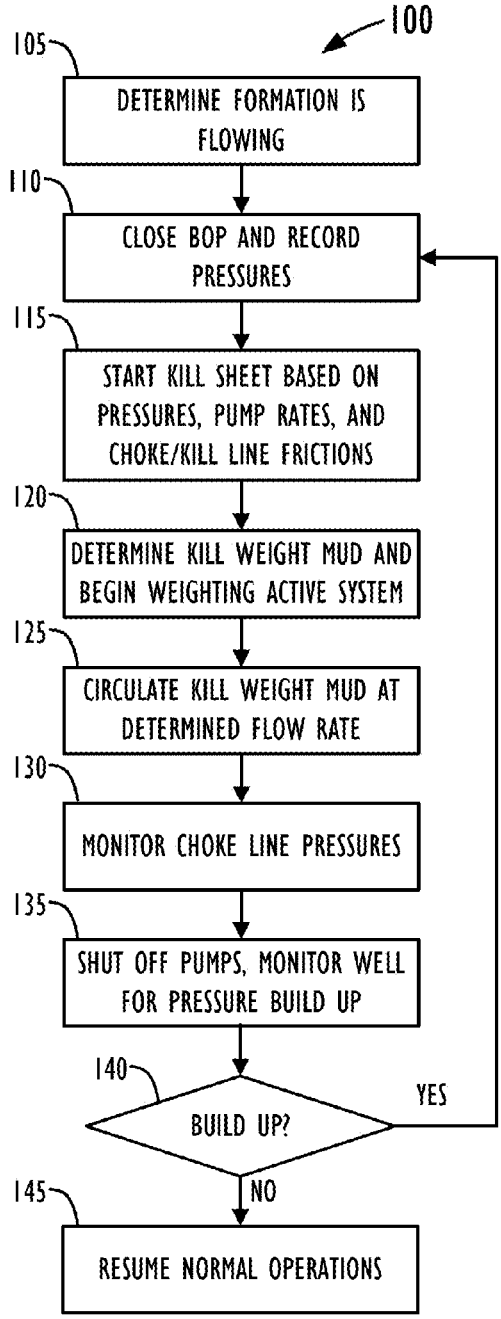
FIG. 1B (Prior Art)
FIG. 1B illustrates a well control operation using a Engineer's Method according to the prior art.
Figure 2A:
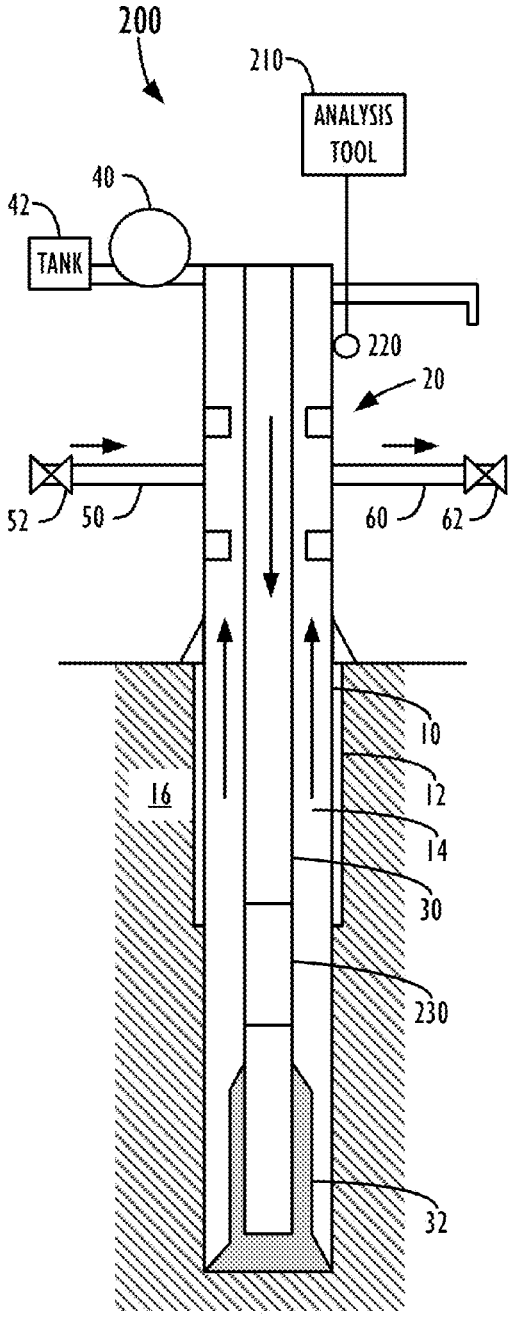
FIG. 2A illustrates a drilling system in accordance with one embodiment of the present disclosure.

FIG. 2A illustrates a drilling system having a well control system 200 according to one embodiment of the present disclosure. The well control system 200 includes analysis tools 210, surface sensors 220, and Logging While Drilling (LWD) tools 230. The analysis tools 210 include, but are not limited to, computers, software, data acquisition devices, rig personnel, etc. The LWD tools 230 are part of a tool string on the drill pipe 30 that can be used for standard logging or measuring while drilling and that can also be used in well control operations according to certain teachings of the present disclosure. Other elements of the drilling system shown are similar to the standard components known in the art.

Figure 2B:
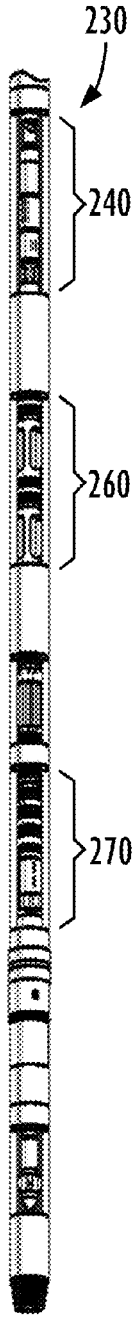
FIG. 2B illustrates a tool string having Logging While Drilling (LWD) tools for use in well control operations according to certain teachings of the present disclosure.

FIG. 2B shows portion of the tool string having several LWD tools 230. As shown, these tools 230 include a pressure modulated telemetry module 240, a battery module 260, and a bore annular pressure module 270. In one embodiment, the LWD tools 230 can be part of a hostile-environment logging (HEL) MWD system designed by Weatherford International Ltd. for high-pressure/high-temperature hostile drilling environments.

The battery module 260 provides power for the other tools 230. For example, the battery module 260 may continuously power the bore annular pressure module 270 to obtain pressure and temperature measurements. The bore annular pressure module 270 has a bore pressure port, an annular pressure port, and quartz transducers for obtaining pressure measurements as well as temperature measurements. The pressure and temperature data can then be communicated to the surface using the telemetry module 240, which uses mud flow and battery power to generate positive mud pulses to send encoded information to the sensors 220 (See FIG. 2A) at the surface of the well. In one embodiment, the telemetry module 240 can include a Pressure Modulated Telemetry (PMT™) system available from Weatherford International Ltd.

Figure 2C:
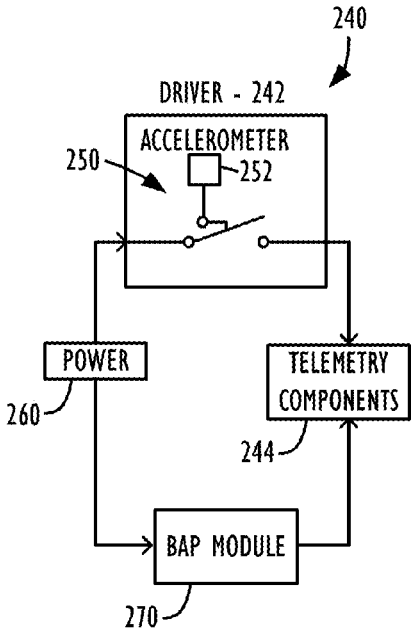
FIG. 2C illustrates one embodiment of a pulse modulated telemetry module for the tool string of FIG. 2B.

The telemetry module 240 is not always turned on and active while downhole. The module 240 is specifically intended to be shut off when the wellbore 10 is shut in so casing and drill pipe pressures can be obtained. As schematically shown in FIG. 2C, the telemetry module 240 includes a driver 242 having a switching mechanism 250 that controls power from the battery module 260 to pressure modulated telemetry components 244, which can include a pulser for example.

The switching mechanism 250 has an accelerometer 252 that is laterally oriented in the module 240 and that is capable of monitoring vibrations while the tools 230 are downhole. The accelerometer 252 may be a piezoelectric based sensor, and it may be similar to an Environmental Severity Measurement (ESM™) sensor available from Weatherford International Ltd. Also, the accelerometer may be a capacitive acceleration sensor or Micro-ElectroMechanical System (MEMS) type sensor.

Using the accelerometer 252, the switching mechanism 250 is designed to detect vibrations in the tool string that indicate that fluid is flowing, the tool string is rotating, and/or the power section (mud motor) is operating. In particular, the accelerometer 252 responds to vibrations, accelerations, and the like while the tool string 30 is downhole. In response to measured data exceeding pre-set thresholds, the driver 242 activates the switching mechanism 250 to provide power to the telemetry components 244. Once activated, the telemetry components 244 then begin transmitting pressure and temperature data from the bore annular pressure module 270 to the surface for detection by the sensors 220.

Figure 3A:
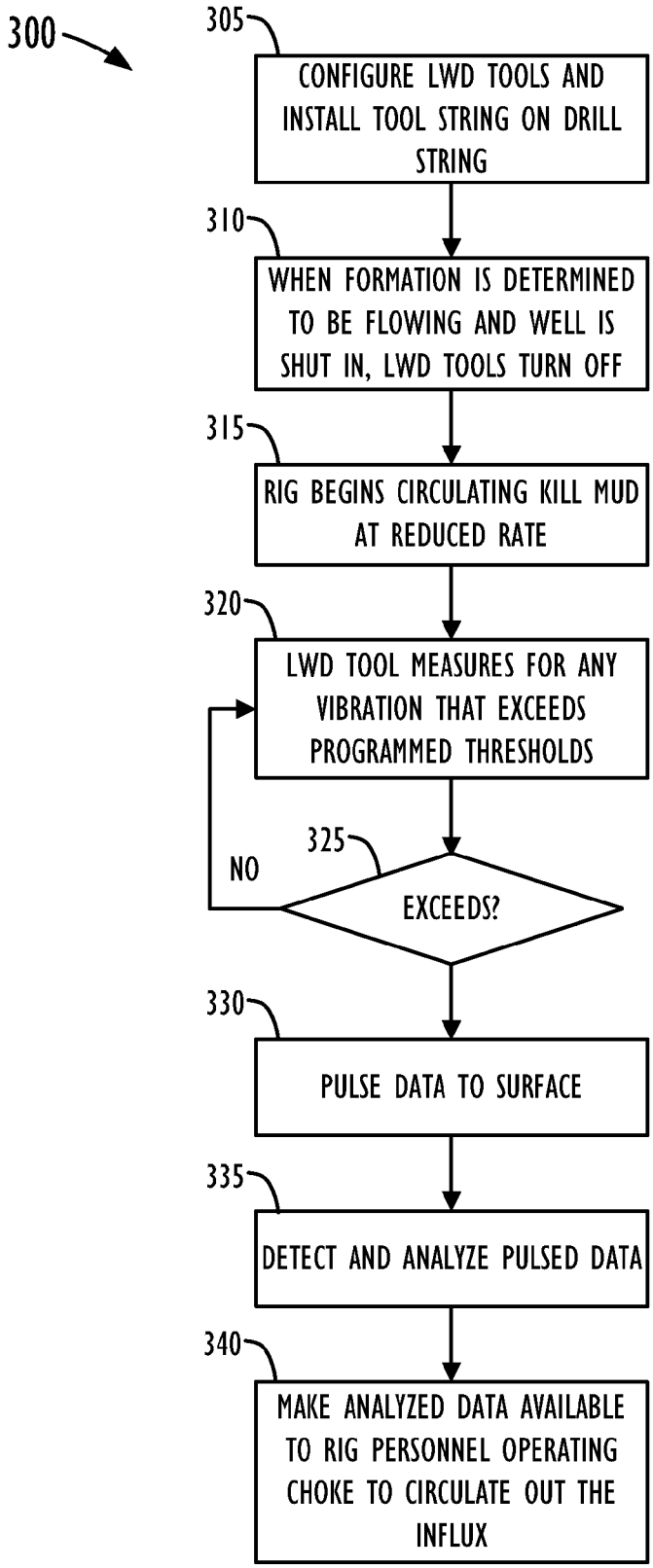
FIG. 3A illustrates operation of the disclosed LWD tools during well control operations according to certain teachings of the present disclosure.

FIG. 3A illustrates a process 300 of operating the disclosed LWD tools 230 during a well control operation according to certain teachings of the present disclosure. Initially, rig operators configure the LWD tools 230 and install the tool string on the drill string 30 (Block 305). In configuring the LWD tools 230, rig operators program the switching mechanism 250 of the driver 242 to turn the telemetry components 244 on when vibration and/or pressure exceeds certain levels so that the telemetry components 244 will begin pulsing data to the surface. In general, the levels are determined based on particular details of a given implementation, such as the well characteristics, pump rates, pressures, etc.

While drilling, a kick may be detected, and the well is shut in. At this point, the LWD tools 230 turn off when the pumps 40 are turned off so that rig operators can observe any shut-in build up pressures in the drill pipe 30 or casing 12 (Block 310). The rig operators perform the necessary well control calculations, weight up the required kill weight mud, and begin to circulate the kill weight mud down the drill pipe 30 at a reduced flow rate to kill the influx (Block 315).

Downhole, the accelerometer 252 measures vibrations that occur from fluid flowing through the drill pipe 30 while the mud is pumped (Block 320), and the driver 242 determines whether the measured data exceeds a predetermined threshold programmed in the module 240 (Decision 325). Once the measured data exceeds the set threshold, the switching mechanism 250 activates the telemetry components 244 to begin pulsing measured pressure and temperature data from the bore annular pressure module 270 to the surface (Block 330). Even if the driver 242 has a pressure sensor (not shown) capable of activating the telemetry components 244, the pressure levels caused by drilling mud being pumped at the slow pump rate would be too low for the pressure sensor to achieve activation during the well control operation. Therefore, it is preferred to use the accelerometer 252 to measure vibrations to achieve activation of the telemetry components 244.

Encoding software known in the art for pulse telemetry can be used in the module 240 to send the measured data to the surface via encoded pressure waves in the fluid of the wellbore 10. The encoding may be based on combinatorial or other techniques. At the surface, sensors 220 detect the pulsed data, which may constitute positive pressure pulses of less than about 15-psi to about 4-psi. Using decoding software, the analysis tools 210 decode and analyze the detected data (Block 335). For example, the surface sensors 220 can be multiple pressure transducers placed throughout the standpipe manifold and gooseneck of the rig to detect the encoded pressure waves.

It will be appreciated that the ability to acquire the pulsed data during the low flow from the slow pump rates of the well control operation can depend on the particular flow rate used, such as the orifice selection, and other implementation-specific details. Drilling noise and pipe rotation will typically be absent during the well control operation so signal noise from these sources will likely not inhibit detection of pulsed data at the surface. Although the lower pump pressure may inhibit the ability to detect the pulsed data, the mode or frequency for pulsing the data with the telemetry module 240 can be changed as needed. For example, to assist detection, a greater pump on time could be used while designing the backup mode. In another example, a downlink unit (not shown) known in the art can be used to switch what frequencies are used for the pulsed data at the module 240 without needing to cycle the pumps. In addition, the program in the telemetry module 240 may only send the pressure data (to determine the equivalent circulating density (ECD) of the mud) and the temperature data to simplify what encoded data would need to be detected and decoded at the surface.

At the surface, the analysis tools 210 can include a computer using software to identify and decode the detected data. During analysis, the analysis tools 210 correct the pressure data for depth downhole and convert the corrected pressure data to local mud weight units. Ultimately, the analyzed, real-time data is made available to rig operators operating the chokes 52/62 on the kill and choke lines 50/60 and attempting to circulate out the influx with the kill weight mud (Block 340). The real-time data measured downhole with the tools 230 automatically accounts for any variations and inconsistencies in the properties of the kill weight mud being pumped downhole. In this way, the analyzed data offers the rig operators substantially more accurate information for conducting the well control operation.

In one advantage, for example, the real-time data enables the rig operators to verify and correct choke and kill line friction pressures during the well control operation so they can more effectively operate the chokes 52/62 and maintain a more constant and consistent pressure at the bottom of the wellbore 10 while performing the operation. In other advantages, the real-time data allows the well control operators to make timely decisions regarding the well control operation and can reduce the potential for non-productive time and improve the safety of well control operation. In yet another advantage, the real-time data can assist rig operators in performing both the Driller's and Engineer's methods. By increasing the accuracy of the data used in the Engineer's method, rig operators can actually decide at the time of a kick whether to use either the Driller's method or the Engineer's method.

As noted above (in Block 305), the switching mechanism 250 is programmed to control the telemetry components 244 in response to measured accelerometer data. More particularly, the switching mechanism 250 activates the telemetry components 244 to begin transmitting real-time telemetry data in response to measured accelerometer data resulting from fluid pumped through the tool string at the slow mud pump rates of a well control operation. Likewise, the mechanism 250 deactivates the components 244 when there is substantially no flow through the tool string. Before activating the telemetry components 244, the mechanism 250 preferably determines that vibrations have been sustained above a predetermined activation threshold for a predetermined amount of time. Conversely, before deactivating the telemetry components 244, the mechanism 250 preferably determines that the vibrations have been sustained below a predetermined deactivation threshold for a predetermined amount of time. The activation and deactivation thresholds may be the same, but the activation threshold is preferably set higher to prevent erratic starts and stops of data transmission caused by false signals.

Figure 3B:
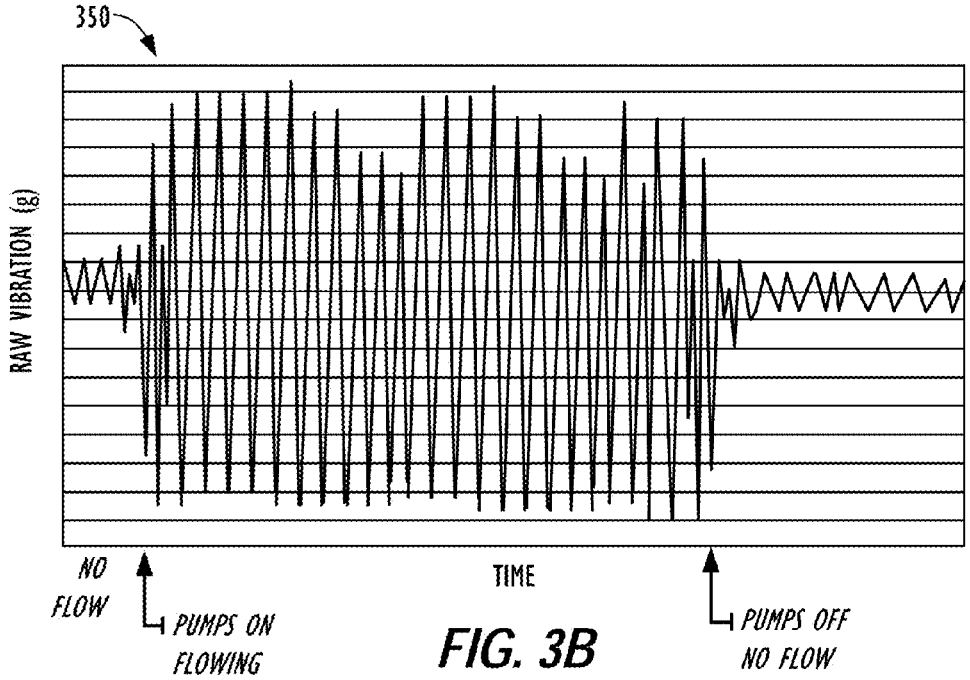
FIGS. 3B-3C illustrate graphs of accelerometer data obtained during operation of the disclosed LWD tools.
Figure 3C:
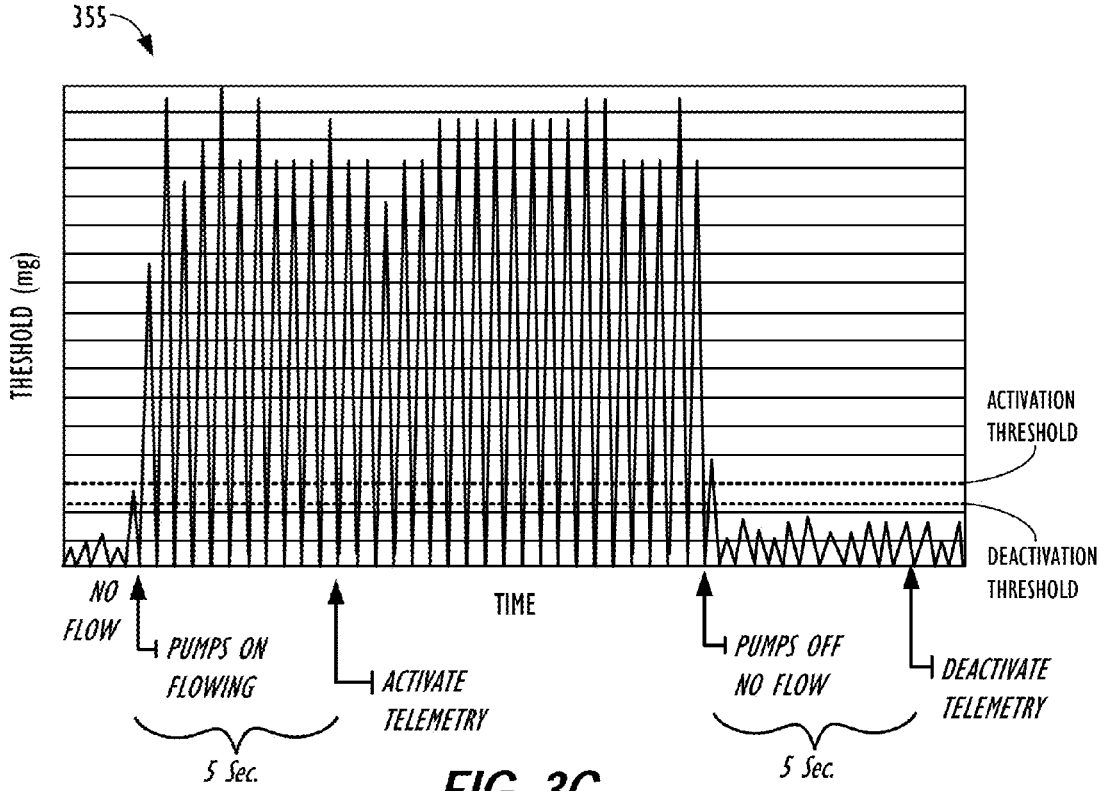

To help illustrate how the switching mechanism 250 is configured to operate, reference now turns to exemplary graphs in FIGS. 3B-3C. The graph 350 in FIG. 3B shows raw vibration measured by the accelerometer (252) during a portion of operation. Initially, there is no flow through the pipe due to shut-in after a kick has been detected. The pumps are then turned on to pump mud at a slow pump rate through the drill string during a well control operation. This flow of mud through the tool string causes vibration, and the accelerometer (252) measures the vibration. The measured accelerometer data may be sampled at any suitable sampling rate, such as 16-Hz, 32-Hz, 64-Hz, 128-Hz, etc. but the sampling rate is preferably at least 32-Hz or greater. Once the pumps are turned off after the mud has been pumped, the vibrations subside.

Preferably, the accelerometer (252) used in the switching mechanism (250) is a capacitive acceleration sensor or Micro-ElectroMechanical System (MEMS) type sensor. Because this type of accelerometer is sensitive to DC acceleration, the DC offset caused by the accelerometer's orientation is preferably removed. To remove the offset, the difference (delta) between the acceleration from sample to sample are compared to produce resulting AC acceleration.

The graph 355 in FIG. 3C shows the AC acceleration (in mg's) resulting from obtaining the differences from sample to sample in the data of FIG. 3B. As shown, the activation and deactivation thresholds are preferably set as low as possible to enable detection of low flow through the tool string expected during the slow pump rates of a well control operation. However, the thresholds are not set so low as to be triggered by thermal noise and other disruptions in the accelerometer data. Preferably, both of the thresholds are at least below 20-mg, but the thresholds are directionally proportional to the sampling rate used for obtaining the data. The Table below provides exemplary threshold values for various sampling rates.

| Sampling Rate | Deactivation Threshold | Activation Threshold |
|---|---|---|
| 16-Hz | 1.22 mg | 1.53 mg |
| 32-Hz | 2.44 mg | 3.06 mg |
| 64-Hz | 4.88 mg | 6.12 mg |
| 128-Hz | 9.76 mg | 12.24 mg |

As mentioned previously, the switching mechanism (250) preferably focuses on sustained periods of data to determining whether to activate or deactivate telemetry during operation. To do this, the switching mechanism (250) can use an accumulator to count how many times the acceleration is greater than the activation threshold or less than the deactivation threshold in recurring periods of 1-second or so. By focusing on the number of consecutive results of the accumulator over a period of time, the switching mechanism (250) can thereby detect sustained levels of vibration (flow) or sustained periods of no vibration (no flow) to ensure proper activation/deactivation of the telemetry components (244). As shown in FIG. 3C, this accumulation technique produces a delay period (e.g., 5-seconds) from the time the pumps are turned on before telemetry is activated and another delay period (e.g., 5-seconds) from the time the pumps are turned off before telemetry is deactivated.

In the above example, the accelerometer data used by the switching mechanism (250) to determine whether to activate/deactivate the telemetry components (244) is related to AC acceleration from sample to sample. In addition to this form of data, however, the switching mechanism (250) may use other forms of data from the accelerometer (252) such as raw acceleration, pipe acceleration, time, etc. With respect to these other forms of accelerometer data, the driver 242 can be programmed to detect variances in these forms of data caused by low flow from the slow pump rates used in a well control operation so that the switching mechanism 250 can respond accordingly and activate/deactivate the telemetry components 244 during the operation.

With an understanding of the disclosed LWD tools 230, their configuration, and operation, we now turn to a discussion of well control operations using the disclosed LWD tools 230.

Figure 4:
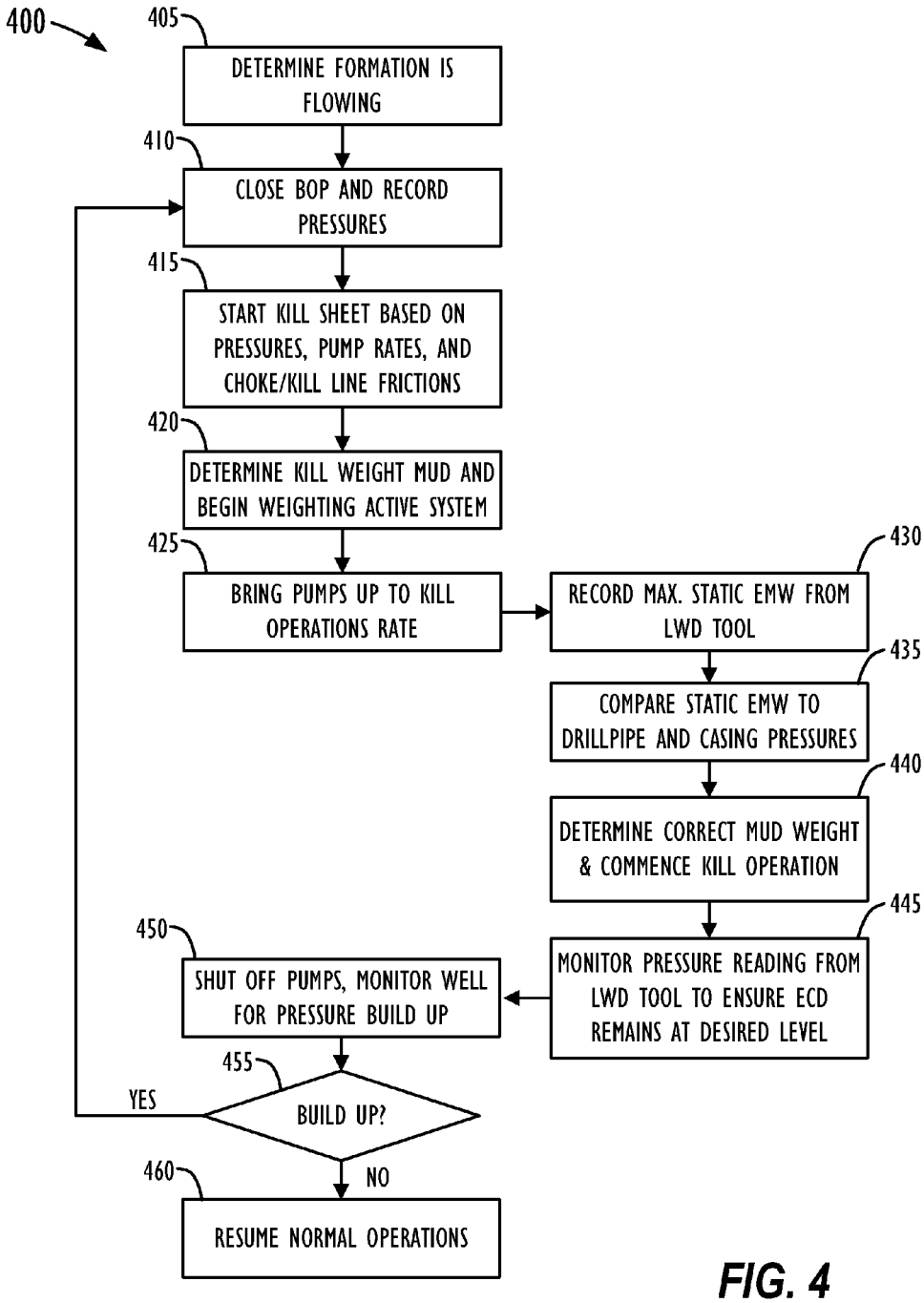
FIG. 4 illustrates a well control operation using the disclosed LWD tools in accordance with one embodiment.

FIG. 4 illustrates a well control operation 400 using the disclosed LWD tools 230 based on the wait and weight or Engineer's method of performing a kill operation. The operation 400 essentially starts out with standard procedures. For example, the well is determined to be flowing due to an influx of fluid from the formation 16 (Block 405), and the rig operators shut-in the well and record the pressures of the drill pipe 30 and the casing 12 (Block 410). Next, the rig operators start the standard "kill" sheet to outline the procedure for controlling the influx in the wellbore 10 (Block 415) and begin weighting up the active system based on the determined weight required for the mud to kill the influx (Block 420). Finally, the rig operators begin circulating the kill weight mud into the system by bringing the mud pumps 40 up to a kill operation speed (slow pump rate) determined by the choke line frictions and the kill sheet (Block 425).

As noted previously, the LWD tools 230 have a switching mechanism 250 configured to turn on the telemetry module 240 when downhole vibrations exceed a predetermined low vibration threshold so that the telemetry module 240 can be activated at the low flow rate during the kill operation to measure downhole data. Turning on the telemetry module 240 in this manner represents one area where the present operation 400 diverges from standard procedures in the art that do not activate tools at low flow rates to make such measurements during a kill operation.

In the present operation 400, the bore annular pressure module 270 measures pressure data that is to determine the static equivalent mud weight (EMW), and the pulsed telemetry module 240 sends the measured pressure data to the surface where the analysis tools 210 determine the maximum static EMW (Block 430). Then, the maximum static EMW is compared to the pressure readings for the drill pipe 30 and casing 12 obtained using standard techniques (Block 435). Based on the comparison, analysis determines the correct mud weight to use for the kill operation, and the rig operators commence the kill operations using that correct kill weight mud (Block 440). At this point if desirable, rig operators may also select what method (i.e., Driller's or Engineer's method) to proceed with.

Continuing with the kill operation, the bore annular pressure module 270 obtains pressure data while the kill weight mud is pumped into the drill pipe 30. All the while, the telemetry module 240 sends the measured pressure data to the surface, and the rig operators monitor the pressure data to ensure that the equivalent circulating density (ECD) of the mud downhole remains at desired levels while the kill weight mud is pumped (Block 445). As is known, the equivalent circulating density (ECD) refers to the effective density of the mud being circulated and exerted against the formation 16. If the ECD does not remain at a desired level while the kill weight mud is pumped, then rig operators can adjust the variable choke 62 as necessary. Typically, the rig operators use the variable choke 62 to maintain the casing pressure constant at a value equal to the shut-in casing pressure minus the choke line friction pressure while the kill weight mud is pumped down the drill pipe 30. When the mud reaches the bit, the rig operators typically use the variable choke 62 to keep the drill pipe pressure constant until the kill weight mud is pumped up the wellbore 10 to the surface. Having real-time information about the equivalent circulating density (ECD) helps the rig operators handle these pressure control procedures while pumping the kill weight mud whose properties may vary due to the various factors discussed previously.

Even though the rig operators are taking action to kill the influx with the kill operation, it is not uncommon during a kill operation to have to stop, make recalculations, and start over again at this point due to faulty assumptions or unknown variables. In general, the kill operation assumes that the kick is caused by an influx of liquid so that the kill operation relies on a liquid model. In a worst case, however, the kick may actually be caused by an influx of gas, which is harder to model. Accordingly, the rig operators use calculations based on liquid model assumptions, which may not adequately account for the actual properties of the influx encountered. Using the LWD tools 230 to obtain real-time downhole pressure data during the low flow rates of the kill operation, however, may reduce the likelihood that the rig operators would have to stop and do a reiteration of various steps in the kill operation. In essence, obtaining the downhole pressure data eliminates some of the uncertainties associated with assuming that the kill pressure is linearly correlated to the mud weight as is the case with the liquid model.

Once a full circulation of kill weight mud has been pumped into the drill pipe 30 and up the wellbore 10 to the surface, the rig operators shut the pumps 40 off and monitor the well for pressure build up on the drill pipe 30 or the casing 12 (Block 450). If there is pressure build up (Decision 455), the operation 400 must be repeated because the kill weight mud was of insufficient weight to hydrostatically balance the formation.

Otherwise, the uncontrolled flow has been stopped, and the rig operators can resume normal drilling operations (Block 460).

Figure 5:
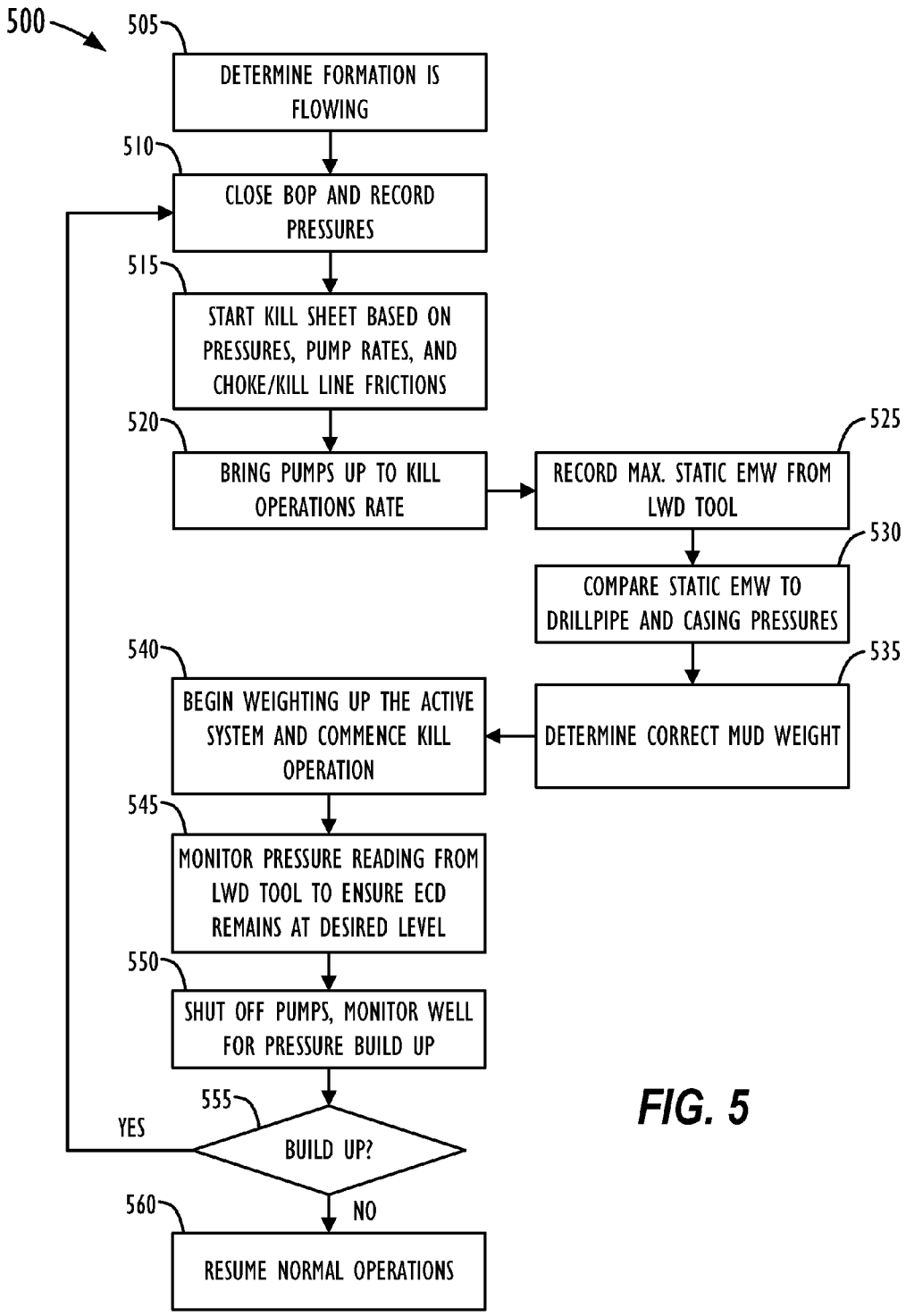
FIG. 5 illustrates another well control operation using the disclosed LWD tools in accordance with another embodiment.

FIG. 5 illustrates a well control operation 500 using the disclosed LWD tools 230 based on the Engineer's method of performing a kill operation. Again, the operation 500 essentially starts out with standard procedures, such as determining that the well is flowing due to an influx (Block 505), shutting-in the well to record drill pipe 30 and casing 12 pressures (Block 510), and starting the standard "kill" sheet (Block 515). In contrast to the Driller's method, the rig operations at this point bring the mud pumps 40 up to kill operations speed as before but pump the existing weight of mud that was being used before the influx was detected (Block 520).

Using the telemetry module 240 configured to turn on in response to vibration levels exceeding predetermined thresholds (See FIG. 3A), the maximum static EMW from pressures measured with the LWD tools 230 is recorded (Block 525) and is compared to the previously measured pressure data of the drill pipe 30 and casing 12 (Block 530). Based on the comparison, analysis determines the correct mud weight to use for the kill operation (Block 535). At this point, the rig operators begin weighting up the active system and commence the kill operation by pumping the kill weight mud into the drill pipe 30 (Block 540). While the kill weight mud is pumped at the low flow rate, the bore annular pressure module 270 makes pressure readings that the rig operators monitor to ensure that the equivalent circulating density (ECD) of the mud remains at desired levels (Block 545). If the ECD does not remain at a desired level while the kill weight mud is pumped, then rig operators can adjust the variable choke 62 as necessary.

Once a full circulation of kill weight mud has been pumped into the drill pipe 30 and back up to the surface through the wellbore 10, the rig operators shut the pumps 40 off and monitor the well for pressure build up on the drill pipe 30 or on the casing 12 (Block 550). If there is pressure build up (Decision 555), the operation 500 must be repeated because the kill weight mud was of insufficient weight to hydrostatically balance the formation. Otherwise, the uncontrolled flow was stopped, and the rig operators can resume normal operations (Block 560).

While the present disclosure focuses on well control operations, the teachings of the present disclosure can be used in other reduced flow situations in a well, such as testing situations of a formation, situations where circulation is lost, situations where returns lost to the formation are experienced, or any other situation in which logging while drilling data may be useful but the pump rates must be reduced from any normally planned drilling speeds. In the lost return situation, for example, operators typically flow at slow pump rates in an attempt to pump and spot pills across trouble zones in the formation. By ultimately supplying accurate pressure data in such a situation, one cause of non-productive time in deepwater can be reduced by the disclosed teachings.

The foregoing description of preferred and other embodiments is not intended to limit or restrict the scope or applicability of the inventive concepts conceived of by the Applicants. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A well control method, comprising:

measuring accelerometer data with a tool driver on a drill pipe in a well;

measuring pressure data with a pressure tool on the drill pipe;

transmitting measured pressure data via drilling mud with a telemetry tool on the drill pipe; and controlling the telemetry tool with the tool driver by— activating the telemetry tool to transmit the pressure data in response to measured accelerometer data caused by drilling mud being pumped into the drill pipe at least at a normal pump rate used during drilling, deactivating the telemetry tool in response to substantial cessation of accelerometer data caused by stopped pumping of drilling mud due to shutting-in of the well after a fluid influx, and reactivating the telemetry tool to transmit measured pressure data in response to measured accelerometer data at least reaching the predetermined threshold caused by drilling mud being pumped at a second pump rate of a well control operation, the second pump rate being used in the well control operation to kill the fluid influx and being slower than the normal pump used during drilling.

2. The method of claim 1, wherein after shutting-in the well in response to the fluid influx during drilling such that the telemetry tool is deactivated, the method comprises:

obtaining drill pipe and casing pressures of the shut-in well while the telemetry tool is deactivated; and pumping drilling mud having a first weight into the drill pipe at least at the second pump rate, whereby the telemetry tool is reactivated.

3. The method of claim 2, further comprising:

sending measured pressure data uphole via drilling fluid;

determining a static equivalent mud weight from the downhole pressure data;

comparing the static equivalent mud weight to the drill pipe and casing pressures; and changing the first weight for the drilling mud to a second weight if necessary based on the comparison.

4. The method of claim 3, further comprising monitoring the measured pressure data from the telemetry tool to ensure that an equivalent circulating density of the pumped drilling mud remains substantially at a desired level while pumping the drilling mud.

5. The method of claim 4, wherein the act of monitoring comprises:

maintaining a current weight for the drilling mud if the equivalent circulating density of the pumped drilling mud remains substantially at the desired level; or adjusting well control parameters if the equivalent circulating density of the pumped drilling mud does not remain substantially at the desired level.

6. The method of claim 3, further comprising:

stopping pumping of the drilling mud; and monitoring the well for pressure build up.

7. The method of claim 6, further comprising:

resuming normal drilling operations if no substantial pressure build-up is monitored; or repeating the act of shutting-in the well if a pressure build-up is monitored.

8. The method of claim 2, wherein the first weight comprises an initial weight for the drilling mud used before the fluid influx or a calculated weight for the drilling mud calculated after the fluid influx.

9. The method of claim 1, comprising initially configuring the telemetry tool by setting a switching mechanism on the drill pipe to switch on the telemetry tool in response to the predetermined threshold being exceeded.

10. The method of claim 9, wherein the act of setting the switching mechanism comprises having the switching mechanism supply power from a power source to the telemetry tool when the accelerometer data exceeds the predetermined threshold for a predetermined amount of time.

11. The method of claim 1, wherein the act of reactivating the telemetry tool comprises reactivating the telemetry tool even when a pressure level caused by drilling mud being pumped at the second pump rate is below a level set to activate a pressure sensor of the tool driver.

12. The method of claim 1, wherein the act of controlling comprises controlling the supply of power to the telemetry tool with the tool driver.

13. The method of claim 1, wherein the predetermined accelerometer data threshold comprises an acceleration below approximately 20-mg.

14. The method of claim 1, wherein the act of measuring accelerometer data comprises sampling accelerometer data at a sampling rate of at least 32-Hz or greater.

15. The method of claim 1, wherein the act of measuring the accelerometer data comprises measuring with an accelerometer for an acceleration level expected to occur from drilling mud being pumped at the second pump rate through the drill pipe.

16. The method of claim 1, wherein the act of transmitting comprises pulsing the measured pressure data to a surface of the well via encoded pressure waves in the drilling mud of the well.

17. The method of claim 1, further comprising using the measured pressure data transmitted by the reactivated telemetry tool to control a choke during the well control operation pumping the drilling mud at the second pump rate.

18. The method of claim 1, wherein the act of measuring pressure with a pressure tool comprises measuring bore pressure and annular pressure with the pressure tool on the drill pipe.

19. The method of claim 1, comprising initially configuring the telemetry tool by selecting the predetermined threshold based on pipe acceleration expected to be caused by drilling mud pumped at the second pump rate through the pipe during the well control operation.

20. A well control system, comprising:

a tool driver positioned on a toolstring and having an accelerometer;

a power supply operably coupled to the tool driver;

a pressure tool operably coupled to the power supply and measuring downhole pressure data; and a telemetry tool operably coupled to the tool driver and the pressure tool, the telemetry tool transmitting measured pressure data via drilling mud and controlled by the tool driver based on measured accelerometer data, wherein in response to measured accelerometer data caused by drilling mud being pumped into the drill pipe at least at a normal pump rate used during drilling, the tool driver activates the telemetry tool to transmit pressure data measured by the pressure tool, wherein in response to substantial cessation of measured accelerometer data caused by stopped pumping of drilling mud due to shutting-in of the well after a fluid influx, the tool driver deactivates the telemetry tool, and wherein in response to measured accelerometer data at least reaching the predetermined threshold caused by drilling mud being pumped at a second pump rate of a well control operation, the tool driver reactivates the telemetry tool to transmit pressure data measured by the pressure tool, the second pump rate being used in the well control operation to kill the fluid influx and being slower than the normal pump used during drilling.

21. The system of claim 20, wherein to reactivate the telemetry tool, the tool driver reactivates the telemetry tool even when a pressure level caused by drilling mud being pumped at the second pump rate is below a level set to activate the tool driver.

22. The system of claim 20, wherein to control the telemetry tool, the tool driver comprise a switching mechanism to control the supply of power from the power supply to the telemetry tool.

23. The system of claim 20, wherein the predetermined accelerometer data threshold comprises an acceleration below approximately 20-mg.

24. The system of claim 20, wherein the tool driver samples the accelerometer for data at a sampling rate of at least 32-Hz or greater.

25. The system of claim 20, wherein to transmit measured pressure data, the telemetry tool sends the measured pressure data to a surface of the well via encoded pressure waves in the drilling mud of the well.

26. The system of claim 20, further comprising an analysis tool obtaining the measured pressure data transmitted by the telemetry tool and providing analyzed data to control a choke during the well control operation pumping the drilling mud at the slow pump rate.

27. The system of claim 20, wherein the pressure data comprises bore pressure and annular pressure.

* * * * *